United States Patent [19]

Dreier

[11] Patent Number: 4,884,519

[45] Date of Patent: Dec. 5, 1989

[54] BOBBIN CASE HOLDER WITH ADJUSTABLE THREAD TENSIONING DEVICE

[75] Inventor: Ernst Dreier, Steckborn, Switzerland

[73] Assignee: F. Gegauf AG Bernina-Nähmaschinenfabrik, Steckborn, Switzerland

[21] Appl. No.: 268,164

[22] Filed: Nov. 7, 1988

[30] Foreign Application Priority Data

Nov. 11, 1987 [CH] Switzerland ..... 4404/87

[51] Int. Cl.[4] ..... D05B 63/00

[52] U.S. Cl. ..... 112/229

[58] Field of Search ..... 112/231, 229, 254; 242/137.1

[56] References Cited

U.S. PATENT DOCUMENTS

| | | | |
|---|---|---|---|
| 3,381,642 | 5/1968 | Bono | 112/229 |
| 3,437,284 | 4/1969 | Philips | 112/229 |
| 3,568,616 | 3/1971 | Coulombe | 112/229 |
| 4,235,178 | 11/1980 | Ackermann | 112/229 |

FOREIGN PATENT DOCUMENTS 435947 11/1967 Switzerland .

*Primary Examiner*—Andrew M. Falik

*Attorney, Agent, or Firm*—Peter K. Kontler

[57] ABSTRACT

A bobbin case wherein a cylindrical wall which surrounds the thread bobbin supports an externally mounted spring having a pan-shaped portion for a disc-shaped thread tensioning member provided with a flat thread-contacting surface which confronts a complementary portion of the external surface of the cylindrical wall. The bias of the spring upon the tensioning member, and hence the force with which the surface of the tensioning member urges the thread against the adjacent portion of the external surface of the cylindrical wall, is adjustable by a screw. The tensioning member is tiltably installed in the pan-shaped portion of the spring so as to adjust its inclination relative to the adjacent portion of the external surface of the cylindrical wall in dependency on the position of the thread.

19 Claims, 2 Drawing Sheets

BOBBIN CASE HOLDER WITH ADJUSTABLE THREAD TENSIONING DEVICE

BACKGROUND OF THE INVENTION

The invention relates to improvements in bobbin cases for sewing machines, and more particularly to improvements in bobbin cases with thread tensioning devices.

It is already known to mount an adjustable thread tensioning device on a wall of a bobbin case, for example, in a manner as disclosed in commonly owned Swiss Pat. No. 435 947 to Gegauf. The thread is caused to pass between the external surface of the cylindrical wall of the bobbin case and an arcuate spring which overlies a portion of the external surface. A screw is provided to permit adjustments of the bias of the spring upon the thread, i.e., the braking action of the spring upon the thread can be varied by rotating the screw so as to cause the spring to store different amounts of energy. The patented bobbin case can ensure highly satisfactory tensioning of the thread if the bias of the spring is properly adjusted and if the configuration of the spring is such that adjustments of its bias actually entail changes in the braking action upon the thread. The making of such springs presents problems when the springs are mass-produced because the radius of curvature of the spring must depart, to a predetermined extent, from the radius of curvature of the external surface of the cylindrical wall of the bobbin case. The making of a spring with a radius of curvature which is slightly smaller than that of the external surface of the cylindrical wall is a prerequisite for establishment of an acceptable tensioning or braking action. Moreover, the configuration of the spring in the axial direction of the cylindrical wall must be constant in order to ensure that the tensioning action will not be increased or reduced if the position of the thread in the axial direction of the cylindrical wall changes (as it normally does when the sewing machine is in use). In other words, it is necessary to ensure that the curvature of the spring in the circumferential direction of the cylindrical wall match or approximate a predetermined value as well as that the configuration of the spring be uniform in the axial direction of the cylindrical wall. This cannot be readily achieved if the spring is to be mass-produced at a reasonable or low cost.

U.S. Pat. No. 3,381,642 to Bono discloses a modified bobbin case for sewing machines wherein the lower thread is tensioned by a thin resilient leaf element which is urged against the external surface of the cylindrical wall of the bobbin case by an arcuate tension regulating ring segment. This bobbin case is also incapable of invariably ensuring that the thread is subjected to a constant tensioning action in spite of repeated changes of position of the thread with reference to the cylindrical wall and the leaf element. The reason is the same as explained above in connection with the proposal of Gegauf, i.e., it is difficult to ensure that the width of the clearance between the external surface of the cylindrical wall and the leaf element will remain uniform in each and every part of the clearance.

OBJECTS OF THE INVENTION

An object of the invention is to provide a novel and improved bobbin case for sewing machines wherein the thread tensioning device is not only simpler but also more reliable than heretofore known thread tensioning devices.

Another object of the invention is to provide a novel and improved thread tensioning device for use in bobbin cases of sewing machines.

A further object of the invention is to provide the tensioning device with novel and improved means for biasing the thread against the external surface of a wall of the bobbin case.

An additional object of the invention is to provide a thread tensioning device which can reliably tension the thread even if its component parts are not machined with a high degree of accuracy.

Still another object of the invention is to provide a novel and improved method of tensioning the thread which issues from the bobbin in a bobbin case.

A further object of the invention is to provide a bobbin case which embodies the above features and advantages and can be used with advantage in existing sewing machines.

SUMMARY OF THE INVENTION

The invention is embodied in a bobbin case for sewing machines. The improved bobbin case comprises a tubular wall which surrounds a properly inserted thread bobbin and has an external surface, a spring which is adjacent the external surface of the wall, and a thread tensioning member which is interposed between the external surface and the spring to bias the thread, which extends from the case, against the external surface. The tensioning member can constitute or include a disc and has a second surface which is adjacent and complementary to the external surface of the wall. The two surfaces are or can be substantially flat. The disc of the tensioning member can be provided with a substantially centrally located projection which extends with at least some radial play into a recess of the tubular wall. Such recess can constitute a hole in the tubular wall. The projection and the surface surrounding the recess can be said to constitute a means for articulately (particularly tiltably) coupling the tensioning member to the wall. In addition to or in lieu of such coupling means, the bobbin case can comprise means for articulately (particularly tiltably) coupling the tensioning member to the spring, and such coupling means can comprise a rivet (e.g., a rivet which is integral with the tensioning member) or a connector having a shank which is integral with or is embedded in the tensioning member and a substantially mushroom-shaped head overlying a portion of the spring.

The spring can be provided with a depression for the tensioning member, and this depression can be defined by a substantially pan-shaped portion of the spring. Such pan-shaped portion of the spring can comprise a first detent member (e.g., a facet which is bent out of the major part of the pan-shaped portion), and the tensioning member can be provided with a complementary detent member (e.g., a socket for the facet) which engages the first detent member.

At least one of the surfaces can be provided with one or more protuberances which extend toward the other surface and establish a gap having a width which preferably approximates the average diameter of a thread or yarn.

The bobbin case further comprises means for adjustably fastening the spring to the tubular wall so as to permit adjustments of the bias of the tensioning member upon the thread between the two surfaces. Such fastening means can comprise a screw or another suitable threaded fastener.

The spring can be provided with a thread guide. If the tubular wall is provided with a customary window, the preferably U-shaped guide can include a leg having a first portion outwardly adjacent the window and a tip which extends into the window. The tubular wall can be further provided with a slot through which the thread extends from the confined bobbin toward and between the two surfaces and thence to the guide.

The novel features which are considered as characteristic of the invention are set forth in particular in the appended claims. The improved bobbin case itself, however, both as to its construction and the mode of using the same, together with additional features and advantages thereof, will be best understood upon perusal of the following detailed description of certain specific embodiments with reference to the accompanying drawing.

DESCRIPTION OF PREFERRED EMBODIMENTS

Figure 1:
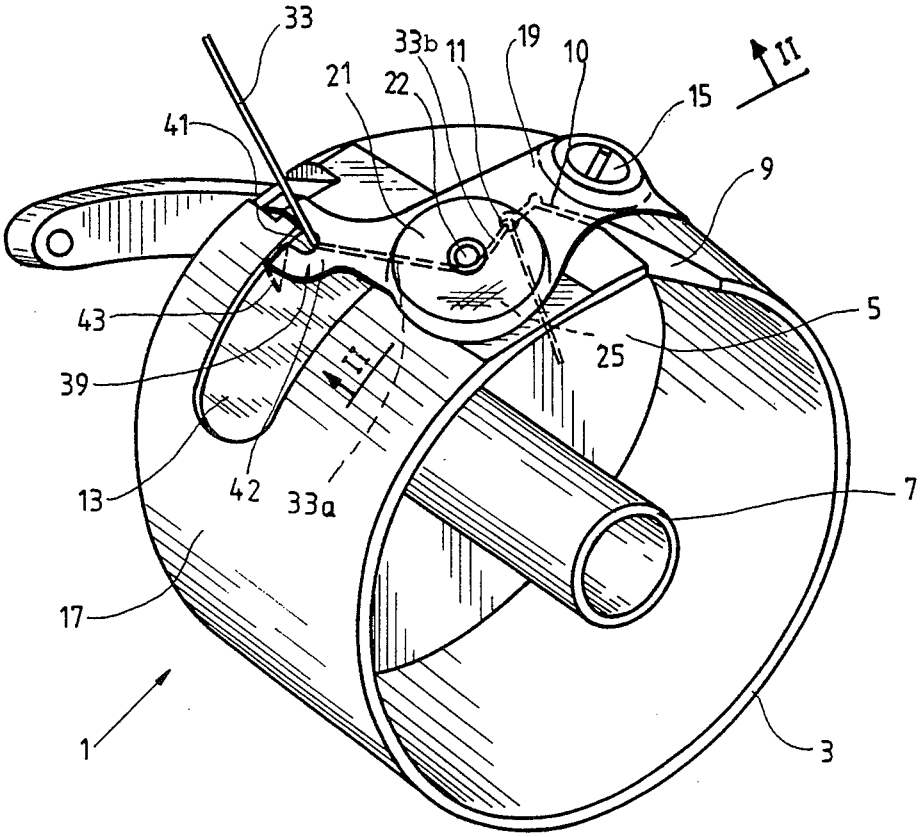
FIG. 1 is a perspective view of a bobbin case which embodies one form of the invention.

FIG. 1 shows a bobbin case 1 which comprises a tubular (preferably cylindrical) wall 3 one end of which is closed by a bottom wall 5. The wall 3 surrounds a customary thread bobbin which is not shown in the drawing. The central portion of the bottom wall 5 carries a hollow pin-shaped mandrel 7 which is coaxial with the wall 3 and carries the core of the properly inserted bobbin for a supply of lower thread 33. The open end portion of the wall 3 is formed with a V-shaped notch 9 forming the inlet of a suitably configurated slot 10 through which the thread extends from the bobbin during threading. The closed end of the slot 9 constitutes a substantially circular opening 11 in the wall 3. A relatively large window 13 is adjacent but angularly offset with reference to the opening 11.

The improved bobbin case further comprises a resilient thread tensioning element 19 (hereinafter called spring) whose curvature approximates but need not exactly match the curvature of the periphery 17 of the wall 3. This spring 19 is adjustably secured to the wall 3 by a fastening means 15 here shown as a threaded fastener (screw) which can be turned by a suitable tool to thereby change the amount of energy which is stored by the spring 19 and hence the bias of a disc-shaped tensioning or braking member 23 upon the thread 33 between the external surface 24 of the wall 3 and the adjacent friction surface 25 of the tensioning member 19 (hereinafter called disc for short). In accordance with a feature of the invention, the surface 25 of the disc 23 conforms to the surface 24 of the wall 3. Each of these surfaces is or can be a flat or practically flat surface. The surface 24 forms part of the periphery 17 of the wall 3.

The disc 23 is confined in the depression of a substantially pan-shaped portion 21 of the spring 19, and the disc is received in the depression with a certain amount of play so that it can be tilted relative to the surface 24 in order to assume an optimum position with reference to portions of the thread 33 between the surfaces 24 and 25.

Figure 2:
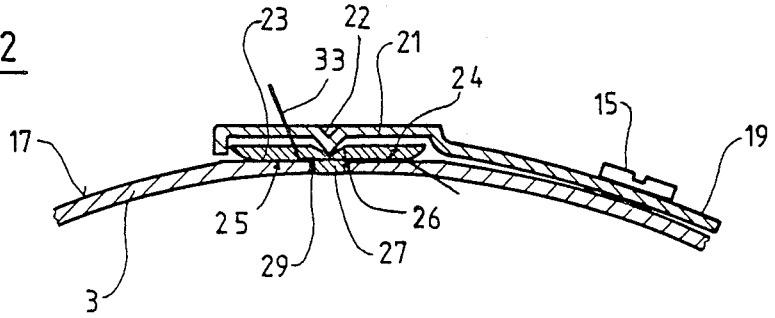
FIG. 2 is an enlarged fragmentary sectional view as seen in the direction of arrows from the line II—II of FIG. 1.

The bobbin case 1 of FIGS. 1 and 2 further comprises means for articulately (preferably tiltably) coupling the disc 23 to the pan-shaped portion 21 of the spring 19. Such coupling means comprises a substantially conical recess or socket 26 in the outer side of the disc 23 and a complementary conical projection 22 provided at the inner side of the portion 21 and extending into the socket 26. The conicity of the projection 22 is more pronounced than that of the surface surrounding the socket 26 so that the disc 23 can be tilted in the depression of the pan-shaped portion 21 of spring 19.

The spring 19 further comprises a substantially U-shaped thread guide 39 which has a notch 41 for the thread 33 and includes a leg 42 having a first portion outwardly adjacent the window 13 and a tip 43 which is bent into the window 13. A portion at least of the notch 41 registers with the window 13. The thread 33 extends between the surface bounding the window 13 and the tip 43 of the leg 42. If desired, the thread guide 39 can constitute a separately produced part which is affixed to the spring 19 or to the wall 3. The parts 19 and 39 can be made of metallic sheet stock.

The thread 33 extends from the bobbin which is disposed within the confines of the wall 3 and surrounds the mandrel 7, through the opening 11 of the slot 9, between the surfaces 24, 25, around the projection 22 and outwardly through the notch 41 of the guide 39. Those portions (**33*a* and 33*b*) of the thread which extend tangentially of the projection 22 make an obtuse angle. This can be readily seen in FIG. 1. The surfaces 24, 25 exert a braking or tensioning action upon the straight thread portions 33*a* and 33*b***.

The notch 10 of the slot 9 facilitates introduction of the thread 33 into the just discussed path. Thus, the free end of the lower thread is engaged by fingers and the thread is caused to pass through the notch 9 and thereupon through the remaining portion of the slot 10 until it reaches the opening 11. At the same time, the thread portion between the free end and the opening 11 is caused to pass between the periphery 17 of the wall 3 and the spring 19 so that it penetrates between the surfaces 24, 25. The thread is caused to partially surround the projection 22 and is thereupon introduced into the notch 41 of the guide 39. The window 13 facilitates such introduction of the thread beneath the tip 41 and thereupon into the notch 41.

Figure 3:
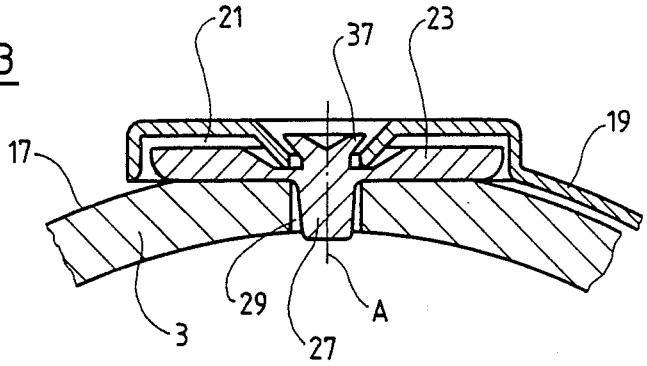
FIG. 3 is a similar fragmentary sectional view of a second bobbin case.

FIG. 3 shows a portion of a modified bobbin case. The difference is that the means for articulately coupling the disc 23 to the pan-shaped portion 21 of the spring 19 comprises a rivet 37 whose head extends outwardly through an opening 38 of the portion 21 and is expanded (deformed) so that the disc 23 is movably (tiltably) coupled to the portion 21. At the same time, the disc 23 is articulately coupled to the adjacent portion of the tubular wall 3. To this end, the wall 3 has a recess in the form of an opening 29 in the central portion of the surface 24, and the disc 23 has a projection 27 which extends, with at least some play, into the opening 29 so that the disc has freedom of tilting movement relative to the wall 3 as well as with reference to the pan-shaped portion 21 of the spring 19. The phantom line A denotes the common axis of the projection 27 and rivet 37; this line also represents the axis of the opening 29 when the surface 25 of the disc 23 is free to fully contact the surface 24 of the wall 3. The disc 23 of FIG. 2 also comprises a projection 27 which extends, with play, into the recess or opening 29 of the adjacent portion of the wall 3.

Figure 4:
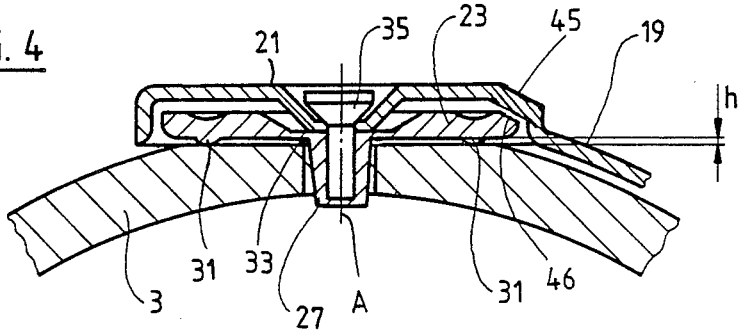
FIG. 4 is a similar fragmentary sectional view of a third bobbin case the section being taken in the direction of arrows from the line IV-IV of FIG. 5.
Figure 5:
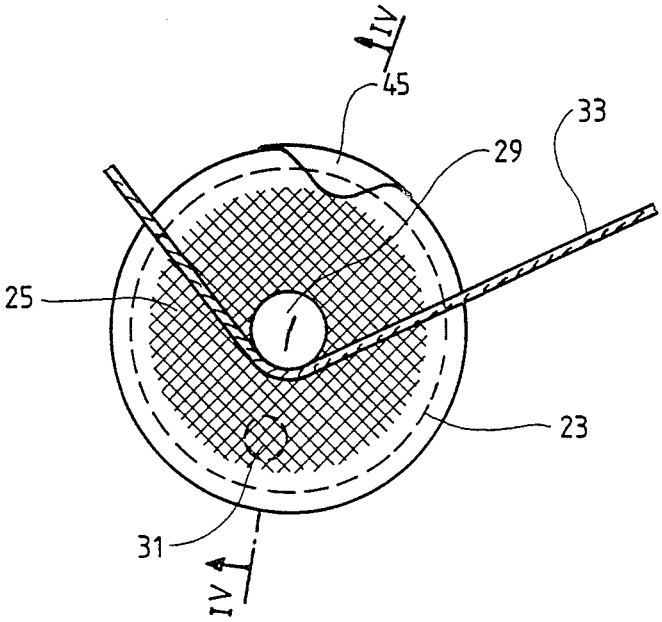
FIG. 5 is a bottom plan view of a portion of the spring of the bobbin case of FIG. 4, the tensioning member being indicated by broken lines.

FIGS. 4 and 5 show a portion of a third bobbin case wherein the major portions of the surfaces 24 and 25 are not in actual contact with each other. To this end, the disc 23 is provided with several rounded protuberances 31 which cause the surfaces 24, 25 to define a narrow gap having a width h which preferably at most equals or approximates the average diameter of a thread or yarn 33. At least one of the surfaces 24, 25 can be serrated and/or otherwise roughened (as indicated by crisscross hatching in FIG. 5). If desired, the protuberances 31 can be provided on the surface 24 of the wall 3. Alternatively, one or more protuberances 31 can be provided on the surface 25 and one or more protuberances can be provided on the surface 24.

FIG. 4 further shows modified means for articulately or rigidly coupling the disc 23 to the pan-shaped portion 21 of the spring 19. Such coupling means comprises a connector 35 with a shank which is embedded in the projection 27 of the disc 23 and with a substantially mushroom-shaped head in a depression of the central region of the outer side of the portion 21. The purpose of the coupling means between the pan-shaped portion 21 and the disc 23 is to ensure that the disc will share the movements of the spring 19, i.e., that the disc cannot become lost when the spring 19 is completely detached from the wall 3. An articulate connection between the disc 23 and the wall 3 and/or pan-shaped portion 21 of the spring 19 is desirable and advantageous because this ensures that the orientation or inclination of the disc 23 relative to the surface 24 of the wall 3 can invariably conform to the location of portions 33*a*, 33*b* of the thread 33 between the surfaces 24 and 25. This, in turn, ensures that the disc 23 can subject the portions 33*a*, 33*b* to a predictable and constant braking or tensioning action.

In order to prevent the disc 23 from turning in the depression of the pan-shaped portion 21 about the axis A, the portion 21 is preferably provided with a male detent member 45 in the form of a facet which is bent inwardly from the spring 19 and extends into a female detent member 46 in the form of a socket for the male detent member 45. Similar detent means can be provided in the bobbin cases of FIGS. 1–2 and 3.

An important advantage of the improved bobbin case is that the tensioning action upon the thread portions between the surfaces 24, 25 is more uniform than in heretofore known bobbin cases. Secondly, the parts of the improved bobbin case (especially the parts which constitute the thread tensioning means) need not be machined with a high degree of precision because the illustrated mounting of the disc 23 ensures the establishment of a desired tensioning action irrespective of eventual shifting of thread portions 33*a*, 33*b* relative to the surfaces 24 and 25. Furthermore, by rotating the screw 15, the person in charge can rapidly select the desired tensioning action because the disc 23 can respond to changes in the amounts of energy which are stored by the spring with a very high degree of predictability and reproducibility. Still further, it as been found that the portions of thread 33 between the surfaces 24 and 25 exhibit little tendency to change their positions with reference to the disc 23. In other words, the thread portions 33*a* and 33*b* tend to travel along a predetermined path on their way from the opening 11 toward the notch 41. Since the disc 23 is installed in the pan-shaped portion 21 with a certain amount of play, it can automatically assume an optimum position in response to stressing of, or in response to relaxation of the stress upon, the spring 19.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A case for a bobbin which carries thread for a sewing machine, comprising a tubular wall having an external first surface; a spring adjacent said first surface; and a thread tensioning member interposed between said first surface and said spring to bias the thread which extends from the case against said first surface, said tensioning member having a second surface which is adjacent and complementary to said first surface, and said surfaces being substantially flat.

2. The bobbin case of claim 1, comprising means for articulately coupling said tensioning member to said wall.

3. The bobbin case of claim 1, comprising means for articulately coupling said tensioning member to said spring.

4. The bobbin case of claim 3, wherein said coupling means comprises a rivet.

5. The bobbin case of claim 3, wherein said coupling means comprises a connector having a substantially mushroom-shaped head.

6. The bobbin case of claim 1, further comprising means for adjustably fastening said spring to said wall so as to permit adjustments of the bias of said tensioning member upon a thread between said surfaces.

7. The bobbin case of claim 6, wherein said fastening means comprises a threaded fastener.

8. The bobbin case of claim 1, wherein said spring comprises a thread guide.

9. The bobbin case of claim 8, wherein said wall has a window and said guide is substantially U-shaped and includes a leg having a first portion outwardly adjacent said window and a tip extending into said window.

10. The bobbin case of claim 8, wherein said wall has a slot through which the thread extends from the interior of said holder, thence between said surfaces and thereupon to said guide.

11. A case for a bobbin which carries thread for a sewing machine, comprising a tubular wall having an external first surface; a spring adjacent said first surface; and a thread tensioning member interposed between said first surface and said spring to bias the thread which extends from the case against said first surface, said tensioning member having a second surface which is adjacent and complementary to said first surface, and said tensioning member including a disc.

12. The bobbin case of claim 11, wherein said disc has a substantially centrally located projection and said wall has a recess receiving said projection with at least some play.

13. The bobbin case of claim 12, wherein said recess is an opening in said wall.

14. A case for a bobbin which carries thread for a sewing machine, comprising a tubular wall having an external first surface; a spring adjacent and having a depression confronting said first surface; and a thread tensioning member interposed between said first surface and said spring to bias the thread which extends from the case against said first surface, said tensioning member having a second surface which is adjacent and complementary to said first surface, and said tensioning member being disposed in said depression.

15. The bobbin case of claim 14, wherein said spring includes a substantially pan-shaped.

16. The bobbin case of claim 15, wherein said portion of said spring has a first detent member and said tensioning member has a complementary second detent member.

17. The bobbin case of claim 16, wherein said first detent member includes a facet and said second detent member has a socket for said facet.

18. A case for a bobbin which carries thread for a sewing machine, comprising a tubular wall having an external first surface; a spring adjacent said first surface; and a thread tensioning member interposed between said first surface and said spring to bias the thread which extends from the case against said first surface, said tensioning member having a second surface which is adjacent and complementary to said first surface, and one of said surfaces having at least one protuberance extending toward the other of said surfaces.

19. The bobbin case of claim 14, wherein said protuberance establishes between said surfaces a gap having a width approximating the average diameter of a thread.

* * * * *